US006935964B2

(12) United States Patent
Del Principe

(10) Patent No.: US 6,935,964 B2
(45) Date of Patent: Aug. 30, 2005

(54) DISPOSABLE NOVELTY SPORTS EQUIPMENT

(76) Inventor: Robert J Del Principe, 501 E. Prospect Ave., Unit 1F, Mt. Prospect, IL (US) 60056

( * ) Notice: Subject to any disclaimer, the term of this patent is extended or adjusted under 35 U.S.C. 154(b) by 0 days.

(21) Appl. No.: 09/883,088

(22) Filed: Jun. 15, 2001

(65) Prior Publication Data

US 2002/0193171 A1 Dec. 19, 2002

(51) Int. Cl.[7] ..... A63B 53/00; A63B 53/10
(52) U.S. Cl. ..... 473/131; 473/316
(58) Field of Search ..... 285/4; 473/316–323, 473/282, 131

(56) References Cited

U.S. PATENT DOCUMENTS

| | | | | | |
|---|---|---|---|---|---|
| 3,087,728 | A | | 4/1963 | Pond | |
| 3,206,205 | A | | 9/1965 | McLoughlin | |
| 3,846,030 | A | * | 11/1974 | Katt | 403/2 |
| D247,057 | S | | 1/1978 | Simmoneau | |
| D247,059 | S | | 1/1978 | Simmoneau | |
| 4,079,936 | A | | 3/1978 | Schachter | |
| 4,129,206 | A | * | 12/1978 | Talbott | 198/377.02 |
| 4,257,635 | A | * | 3/1981 | Mainprice | 294/1.4 |
| 4,690,404 | A | | 9/1987 | Yoder | |
| 4,936,582 | A | * | 6/1990 | Bernstein | 473/131 |
| 5,042,805 | A | * | 8/1991 | Nakai | 473/320 |
| 5,094,454 | A | | 3/1992 | Schering | |
| 5,219,163 | A | | 6/1993 | Watson | |
| 5,221,267 | A | * | 6/1993 | Folden | 604/200 |
| 5,820,438 | A | | 10/1998 | Horton | |
| 5,943,758 | A | * | 8/1999 | Haas | 29/516 |
| 5,968,309 | A | | 10/1999 | Tarr | |

* cited by examiner

*Primary Examiner*—Steven Wong
(74) *Attorney, Agent, or Firm*—Ryan Kromholz & Manion, S.C.

(57) ABSTRACT

Disposable novelty sports apparatus has the appearance of authentic sports equipment and has a resilient shaft material allows a frustrated or stressed sports player to selectively determine whether to permanently break or to dramatically bend the sports equipment in a cartoon-like manner, thus alleviating pent up stress or frustration.

5 Claims, 9 Drawing Sheets

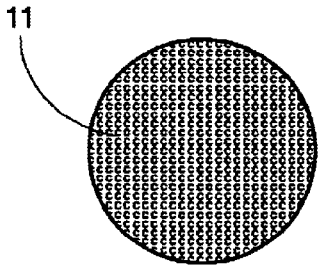
Fig. 7A
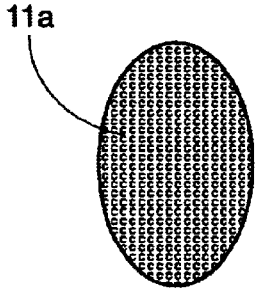
Fig. 7B
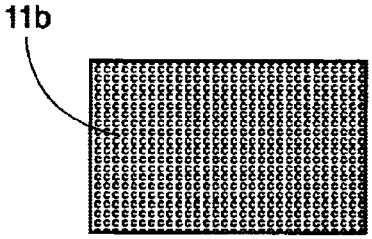
Fig. 7C
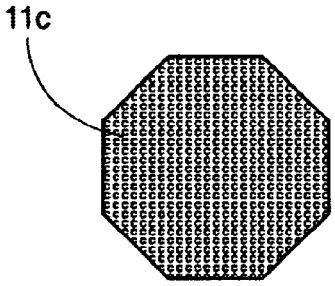
Fig. 7D
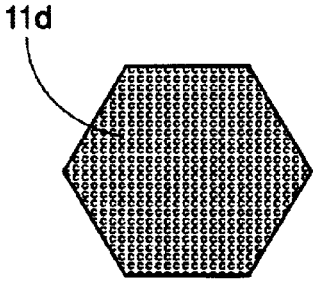
Fig. 7E
Fig. 7

DISPOSABLE NOVELTY SPORTS EQUIPMENT

FIELD OF THE INVENTION

This invention relates to novelty sports equipment.

BACKGROUND OF THE INVENTION

Amateur and recreational sports, while designed for enjoyment, exercise, hobby, or for general health and welfare, are invariably filled with moments of stress. The rigors of friendly competition, the desire to seek personal bests or achieve personal goals, and difficult tasks associated with many sport activities combine, thereby inducing stress in the player. Recognizing the need for devices that assist the frustrated player alleviate unwanted stress, many prior art devices have attempted to use a humorous feature in a novelty or toy sports device. To that end, many novelty sports devices are known. One specific area of novelty sports apparatus is novelty golf clubs. Another area of novelty sports apparatus is toy bats. Yet another area of novelty sports apparatus is novelty tennis racquets.

In the area of prior art novelty golf clubs, a representative example is Bernstein (U.S. Pat. No. 4,936,582). Bernstein describes an unbreakable simulated golf club, designed to emulate a conventional club. It is a single piece, having the grip, shaft and head portions of the club simultaneously molded as a single, contiguous piece. Further, the Bernstein novelty club is designed with a rigid shaft, while flexible to a degree, it is designed to appear as a conventional club and retain the stiffness and "feel" of a conventional club, yielding only to an intentional force and returning to its original shape after being deflected. It is not designed to break, nor is it intended to be disposable.

Pond, in U.S. Pat. No. 3,087,728 describes a breakable wooden conventional club. The Pond club has the appearance and feel of a conventional club and is not designed to be disposable. It incorporates a pin that is designed to fracture under a specified load. To repair the club, the pin is replaced and the club re-assembled.

As another example, in U.S. Pat. No. 3,206,205, McGlaughlin describes another embodiment of a breakable golf club in which a wooden dowel fractures when the club is broken in half. Inside a multi-component hollow shaft is a wood dowel. When the club is broken, the wooden dowel is replaced and the hollow shaft is left undamaged. The McGlaughlin club is designed for conventional play. Another embodiment of the prior art for novelty golf clubs is Schering in U.S. Pat. No. 5,094,454. Schering uses a metal shaft coated with a plastic sleeve. The plastic sleeve is designed to protect the finish of the metal shaft. The Schering club appears to be a conventional club and can be used in place of a convention club in regular play. The shaft is designed to be deformed by application of a force, but the rigid shaft is not elastic. To return to the original shape, the user must apply a new force to straighten the club. After repair it can be re-used.

Novelty sports apparatus extends also to baseball bats. For example, Schachter (U.S. Pat. No. 4,079,936) describes a toy bat constructed of a single piece of semi-rigid and resilient solid foam or rubber. The Schachter bat is soft and intended to flex when used to strike other objects or people, without causing injury or harm.

Another novelty bat is described by Yoder (U.S. Pat. No. 4,690,404). Yoder shows a tagging stick, which is a long cylindrical bat composed of a resiliently flexible cellular foam material, such as polyurethane foam. The foam material is stiff enough to allow grasping and swinging by a human hand, but soft enough to strike other objects or people, without causing injury or harm.

Yet another novelty bat is described by Horton (U.S. Pat. No. 5,820,438) is a simulated baseball bat designed to display advertising and comprising a rigid handle that is removably attached to a soft, pliant foam bat shaft.

Watson (U.S. Pat. No. 5,219,163) also describes a novelty bat for therapeutic or recreational use and comprises a rigid handle permanently affixed to a soft, long and flexible tubular member.

Novelty tennis racquets are also known. For example, Simmoneau (U.S. Des. Pat. No. 247,057) describes a novelty tennis racquet having two heads connected to a handgrip by a single rigid shaft that is "Y"-shaped.

Another attempt to produce a comical or novelty tennis racquet is described again by Simmoneau in U.S. Des. Pat. No. 247,059. A standard tennis racquet head is connected to a grip by a single rigid and bent shaft, the shaft related to the head at an obtuse angle.

Other flexible novelty devices are known, such as a bendable novelty toothbrush as described by Tarr (U.S. Pat. No. 5,968,309). The toothbrush comprises a rigid thermoplastic shaft that is bendable with the application of heat and pressure. Thus, the toothbrush can be formed into a fun shape, a bracelet for example, when the toothbrush is no longer required to perform its primary function of cleaning teeth.

Despite the variety of novelty sports apparatus in the prior art, such sports equipment is not without its deficiencies. The prior art does not permit the frustrated player to express the frustration and stress in a dramatic way. The prior art does not so closely simulate the authentic piece of sports equipment to make comical, the cartoon-like bending of a resilient shaft.

Further, the prior art generally is not designed to repeatedly return to the original shape once a bending load is removed. Further, the prior art is unable to allow the player to selectively determine whether to dramatically bend the device or to break the device into pieces, in a drastic outplay of pent-up stress.

Further, the prior art is wasteful as it employs expensive manufacturing processes, assembly techniques or material.

Therefore, there is a need in the art of novelty sports apparatus for such equipment that has the appearance of authentic sports equipment. It is another need to provide novelty sports apparatus that is resilient with the ability to dramatically bend under the load applied by the player. Further, it is desirable to have the player selectively determine whether to break the novelty sports apparatus or to dramatically bend the sports equipment. A further need is for novelty sports apparatus that is economical to manufacture.

SUMMARY OF THE INVENTION

Noting the aforementioned deficiencies in the prior art, the embodiments of the preset invention provide disposable novelty sports apparatus that has the appearance of authentic sports equipment and simultaneously allows the player to selectively determine whether to break the novelty sports apparatus or to dramatically bend the apparatus. Further, such embodiments are economical to manufacture.

One aspect of this invention provides the frustrated athlete with a device to reduce stress in a comical manner. Another aspect of this invention provides such a device that closely resembles an actual piece of authentic sports equipment.

Yet another aspect of the invention provides a resilient device that can be dramatically bent to cartoon-like proportions, yet return to its original shape. According to another aspect, force can be applied to bend the device to such an extreme so that the device breaks into two pieces. According to still another aspect, the breaking of the resilient device will occur along a predetermined score line.

Several specific embodiments of this invention can be readily envisioned by a person skilled in the art. By means of clarifying example, and not limiting in scope, some embodiments of the invention are described in sufficient detail to enable those skilled in the art to practice the invention.

One embodiment provides a disposable novelty sports apparatus comprising a shaft having a grip end and an oppositely spaced equipment end. The shaft comprises a polymer material that resiliently bends in response to a bending force applied between the grip end and the equipment end. The polymer material allows a resilient bending of the shaft in response to the bending force. The bending force thus causes the shaft to deflect to a bend angle within determined parameters. The polymer material has an elastic memory to allow return of the shaft to a generally straightened and original condition once the bending force is removed. In this embodiment, the shaft further has a score line formed on the shaft between the grip end and the equipment end. The score line comprises a line of weakness along which the shaft will permanently break in response to application of the bending force within a specified range, or when the shaft is deflected to a determined bend angle that exceeds the determined parameters.

In various embodiments, the shaft can possess different cross sectional geometries, e,g., generally curvilinear, such as generally round or generally elliptical; or generally rectilinear, such as generally rectangular, generally octagonal, or generally hexagonal.

In one embodiment, the bend angle is a range of angles having a minimum bend angle and a maximum bend angle. In one arrangement, the minimum bend angle is about 25 degrees. In one arrangement, the maximum bend angle is about 75 degrees.

In various embodiments, the polymer material can vary being, e.g., a resilient polymer, such as plastic or PVC. The polymer material can, e.g., be extruded, or molded, or machined.

The nature of the equipment head can vary. For example, it can comprise a golf club head, or a racquet head, or a tennis racquet head, or a racquet-ball racquet head, or a badminton racquet head, or a baseball bat, or a pool cue.

A host of disposable novelty sports items can thereby be provided, e.g., a disposable novelty golf club, or a disposable novelty racquet, or a disposable novelty baseball bat. The disposable novelty racquets, for example, could include racquet ball, table tennis, or badminton. A wide variety of sports paraphernalia may also be made within the spirit and scope of this invention; for example, pool cues, bowling pins, croquet mallets, hockey sticks, hurley sticks, lacross sticks, cricket sticks and the like.

Regardless of the particular sport, the invention provides the frustrated player the ability to relieve stress and frustration in a dramatic, but inexpensive, manner. The invention allows the player to repeatedly bend a resilient shaft, which can deflect to dramatic and cartoon-like angles, but which nevertheless has the ability to return to its original shape when the bending load has been removed. A larger prescribed bending load will permanently break the shaft into two pieces.

Another aspect of the invention provides a method of using disposable novelty sports apparatus. The method provides a disposable novelty sports apparatus having a shaft to a user. The shaft comprises a resilient polymer material. According to the method, the user grasps an end of a shaft with one hand and grasps a second end of the shaft with another hand. According to the method, the user bends the shaft to a range of bend angles, not to exceed a predetermined maximum bend angle. The shaft resiliently returns to a normal position when the user releases the first and second ends of the shaft.

In one embodiment, the shaft includes a score line. In this embodiment, the user flexes the shaft beyond the maximum bend angle, which breaks the shaft at the score line. The user is thereby free to dispose of the broken shaft, which serves as a symbol of stress and frustration that has been conquered.

Methods that embody features of the invention encourage a user to manipulate the resilient shaft in a dramatic and humorous way to relieve frustration and stress.

The invention makes possible an array of novelty sports equipment which is disposable and which can be bent manually or upon striking an object, such as the ground, or a tree, and be resiliently restored to its original shape. In various embodiments, novelty sports apparatus can be broken into two pieces by a manual bending or striking against an object, e.g., by utilizing a score line on the shaft of the apparatus. The novelty sports apparatus can be inexpensive to produce and use, encouraging a healthy outlet for relief of frustrated golfer's stress.

Features and advantages of the inventions are set forth in the following Description and Drawings, as well as in the appended claims.

DESCRIPTION OF THE DRAWINGS

FIG. 7 is a representation of various cross sections of selected embodiments of the invention.

The invention may be embodied in several forms without departing from its spirit or essential characteristics. The scope of the invention is defined in the appended claims, rather than in the specific description preceding them. All embodiments that fall within the meaning and range of equivalency of the claims are therefore intended to be embraced by the claims.

DETAILED DESCRIPTION

Although the disclosure hereof is detailed and exact to enable those skilled in the art to practice the invention, the physical embodiments herein disclosed merely exemplify the invention which may be embodied in other specific structure. While the preferred embodiment has been described, the details may be changed without departing from the invention, which is defined by the claims.

Figure 1:
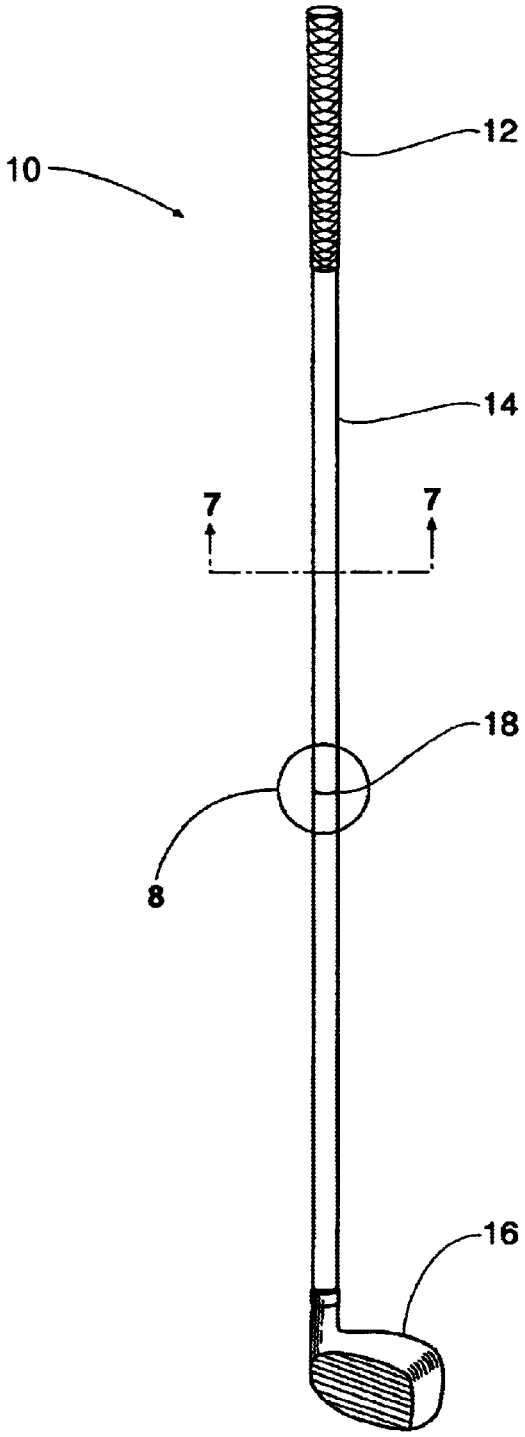
FIG. 1 is an isometric view of a specific embodiment of the present invention representing a golf club.

FIG. 1 shows one embodiment of disposable novelty sports equipment, specifically a disposable novelty golf club 10. Embodying features of the present invention, the golf club comprises a shaft 14 having a club head 16 and a grip 12 located at opposing ends of the shaft 14.

Referring to FIGS. 7A through 7E, the shaft, in one embodiment has a round cross section 11 (as shown in FIG. 7A), but could be made from other shapes, for example, elliptical 11A (as shown in FIG. 7B), rectilinear 11B (as shown in FIG. 7C), octagonal 11C (as shown in FIG. 7D), or hexagonal 11D (as shown in FIG. 7E).

Referring again to FIG. 1, the shaft 14 is made from, for example, a rigid and resilient solid material that is molded or extruded from a resilient polymer. The resilient polymer comprises, for example, a general purpose grade polyvinyl chloride compound (PVC) known in the industry as Type I Grade I having a cell classification of 12454 as defined in ASTM D1784. To provide an authentic appearance, the shaft 14 is colored, for example, gray. Other colors and other thermosetting materials, natural rubber or other plastic materials with similar properties are contemplated.

In one embodiment, the polymer material resiliently bends in response to a bending force applied between the grip end and the equipment end. Another desired characteristic is that the polymer material allows a resilient bending of the shaft in response to the bending force, the bending force thus causing the shaft to deflect to a bend angle within determined parameters. Further, the polymer material has an elastic memory to allow return of the shaft to a generally straightened and original condition once the bending force is removed.

Still referring to FIG. 1, shaft 14 has an annular score line 18 located, for example, at an approximate midpoint of the shaft 14. The score line 18 could be placed at any point or at multiple points along the shaft 14. The score line 18 is formed by scribing the shaft 14 at the desired location with, for example, a pipe cutter commonly used by plumbers, or any similar device. The score line 18 creates a line of weakness on the shaft 14.

More specifically, the annular score line 18 is formed on the shaft 14 between the grip end 12 and the equipment end 16, for example at the approximate midpoint of the shaft. The score line creates a line of weakness along which the shaft will permanently break in response to application of the bending force within a specified range. The shaft will break, alternatively, when the shaft is deflected to a dramatic and determined bend angle that exceeds the determined parameters.

Figure 8:
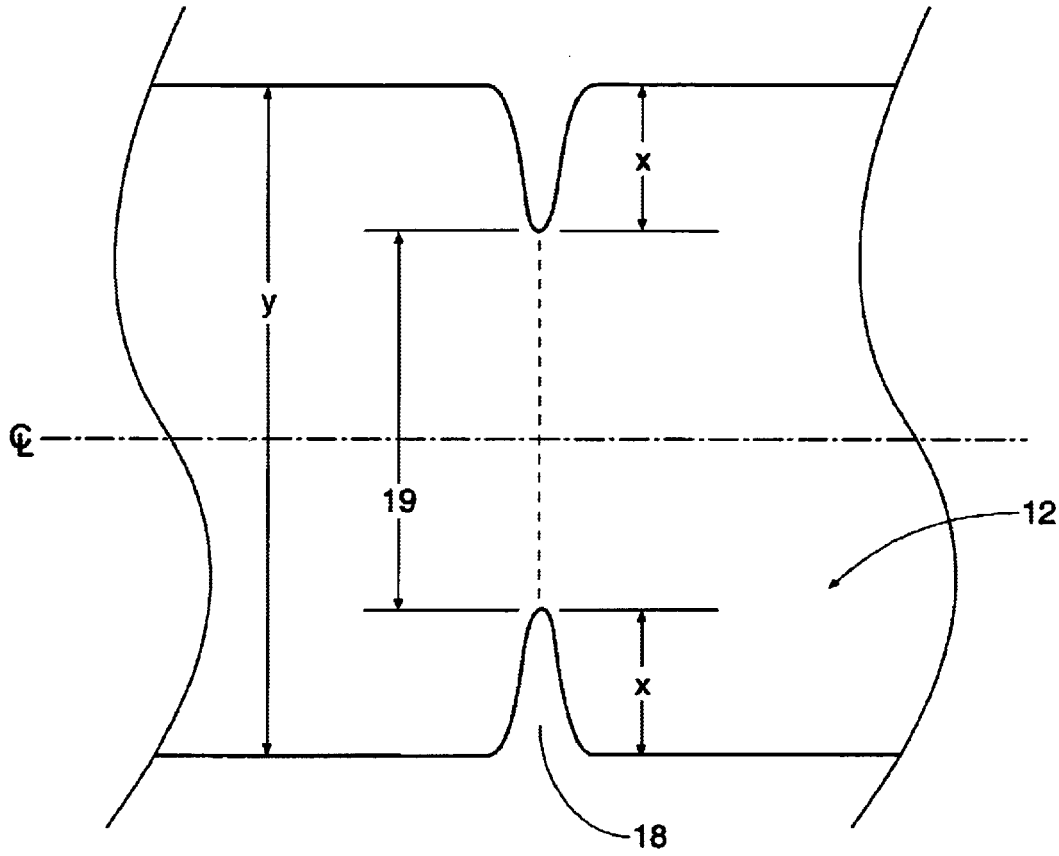
FIG. 8 is a detailed view of the score line and the score ratio of a selected embodiment of the invention.

Now referring to FIG. 8, the score line 18 is scribed to a predetermined depth X. A score diameter 19 results from scribing the score line. This can alternatively be defined as a score ratio. The score ratio is the ratio between the score depth X and a cross section diameter Y of the shaft 12. This may be expressed as X/Y or as a percentage. The desired breaking force can then be controlled by the physical properties of the shaft (e.g., material and length of the shaft) and the score ratio.

Given a shaft having essentially the same physical properties, the breaking force required to break the shaft will decrease as the score ratio increases. In the particular embodiment of a novelty golf club, an example of the breaking force for a typical novelty golf club is in a range of about 25 to 30 lbs. In this sample embodiment, the shaft is made from the resilient polymer known in the industry as PVC Type I Grade I having a cell classification of 12454 as defined in ASTM D1784. In this example, the depth of the score line is the range of about 1/16" to 3/32" (0.0625 in. to 0.09375 in) for a shaft having an outside diameter of ½" (0.50 in.) The resulting score ratio is in the range of about 0.125 to 0.1875. However, in alternative embodiments using the resilient polymer described above, score depths may be used from as great as ⅛" (0.125 in.) to as little as 1/32" (0.03125) for a shaft having a nominal outside diameter of ½" (0.50 in.), which results in score ratios in the range of about 0.0625 to 0.25.

Score ratios in the above-described ranges produce the dramatic bending effect of the present invention.

Applying the same principle, it is understood that increasing the score ratio would reduce the required breaking force. Thus, the breaking force in another embodiment could be reduced, allowing, for example, a child to permanently break the shaft. Therefore, it can be understood that the breaking force can be tailored to the specific embodiment based on, for example, the intended user.

Still referring to FIG. 1, to achieve an appearance of an authentic golf club, the grip 12 is, for example, a conventional type grip such as cloth tape, rubberized tape or a conventional sleeve-type grip. However, a machined or molded grip that simulates a conventional grip is also contemplated. The grip 12 is fixably or integrally attached to the shaft 14 at one end. The shaft 14 may be inserted into a portion of the grip 12 to facilitate attachment. Also to achieve the appearance of an authentic golf club, the head 16 may be a conventional type golf club head, such as a driver, or an iron, or a putter, for example. Alternatively, the head 16 may be, for example, a simulated or novelty head, which is not designed to strike the ball. The head 16 may also be formed by, for example, a machining or extruding or molding operation and therefore may be integral to the shaft.

Figure 2:
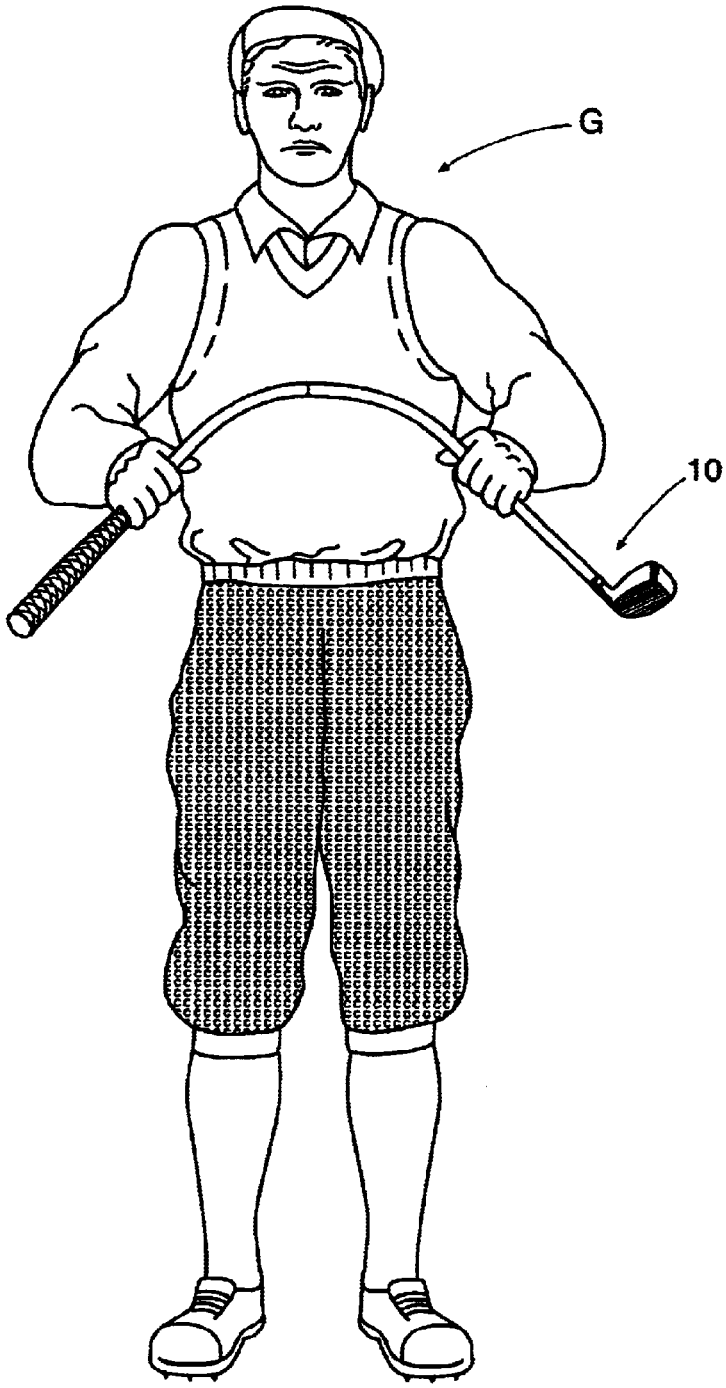
FIG. 2 is a representation of an embodiment, in which a bending load is applied by a frustrated golfer.

Now referring to FIG. 2, an embodiment of disposable novelty sports equipment, specifically a disposable novelty golf club 10 is depicted in a dramatic, cartoon-like bend with a frustrated golfer G applying a bend load.

Figure 6:
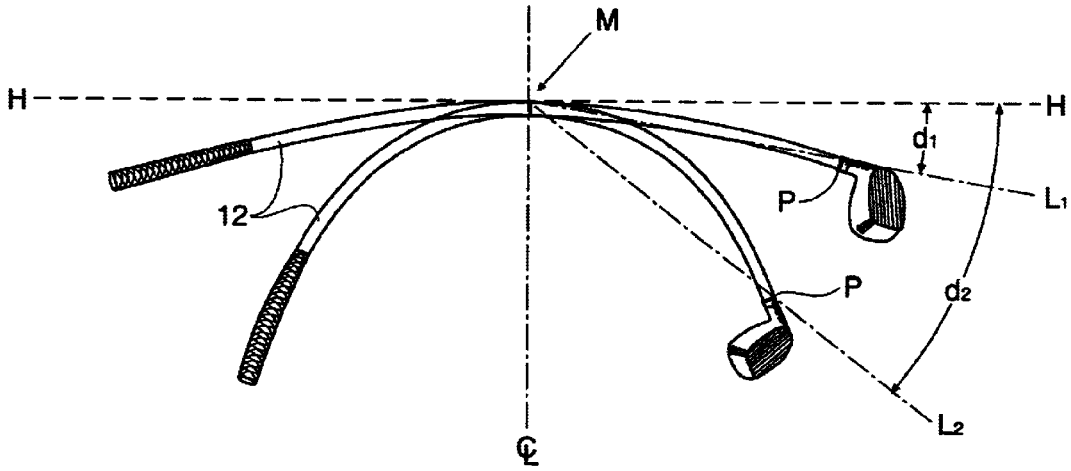
FIG. 6 is a representation of various bend angles in one embodiment of the invention.

Referring now to FIG. 6, a range of bend angles is shown. A minimum bend angle $\alpha_1$ is defined as the angle created between a horizontal reference line H and a construction line $L_1$ defined from the approximate midpoint M of the shaft 12 to a point P on an end of the shaft 12. In a similar manner, a maximum bend angle $\alpha_2$ is depicted. The maximum bend angle $\alpha_2$ is defined as the angle between the horizontal reference line H and a second construction line $L_2$ which is defined as a line made between the approximate midpoint M of the shaft 12 and the point P on an end of the shaft 12. In one embodiment, the minimum bend angle $\alpha_1$ is 25 degrees and a maximum angle $\alpha_2$ of 45 degrees. If the maximum bend angle $\alpha_2$ of 45 degrees is exceeded, the shaft 12 will permanently break. At any angle less than, for example, 45 degrees, the resilient shaft will deflect or bend and return to the original shape. While one embodiment has a target maximum bend angle of 45 degrees, it will be understood by one skilled in the art that any maximum bend angle less than 90 degrees will produced the desired dramatic, cartoon-like bending of the present invention.

Figure 2A:
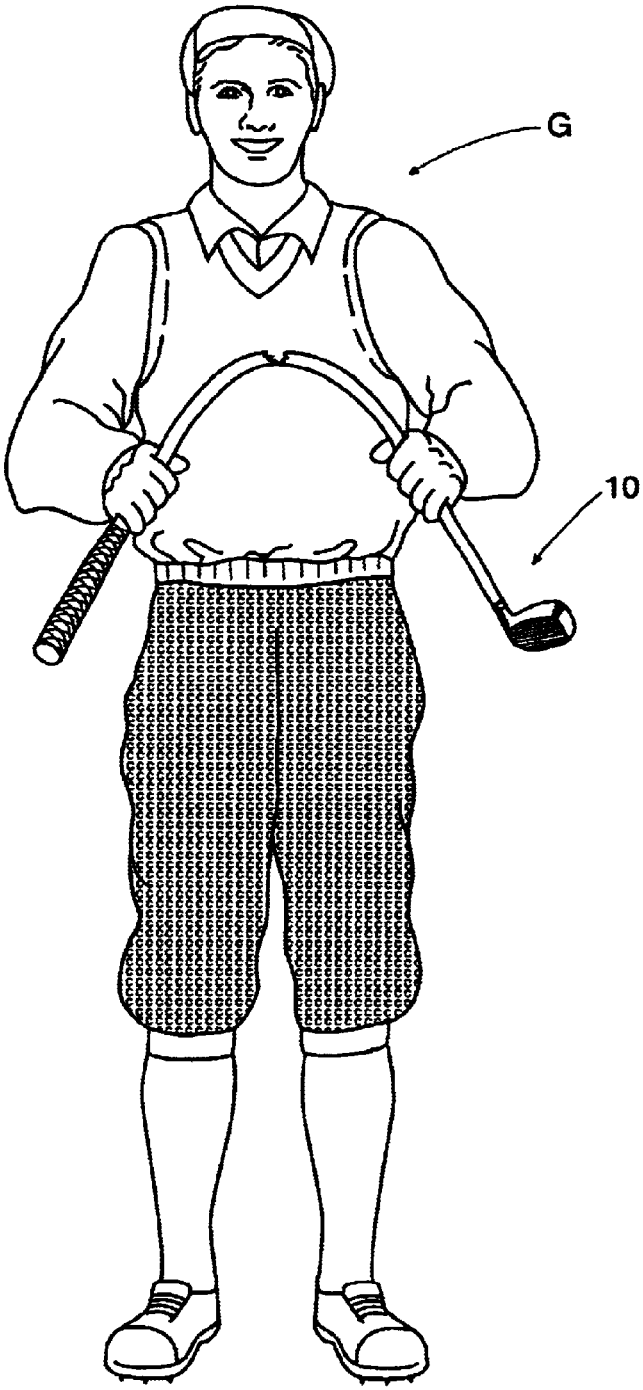
FIG. 2*a* is a representation of an embodiment, in which a broken club held by a stress-free golfer.
Figure 3:
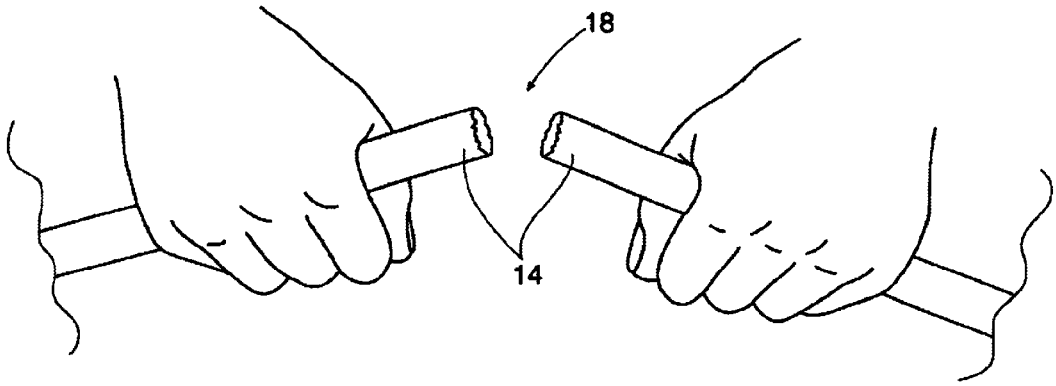
FIG. 3 is a detailed view of the present invention after a pre-determined force has been applied resulting in a broken shaft.

Referring now to FIG. 2*a* and FIG. 3, the now stress-relieved golfer G is depicted as the range of the bend angle has been exceeded and the club 10 is shown breaking in FIG. 2*a*. FIG. 3 shows a detail of the broken shaft 14 at the score line 18.

Figure 4:
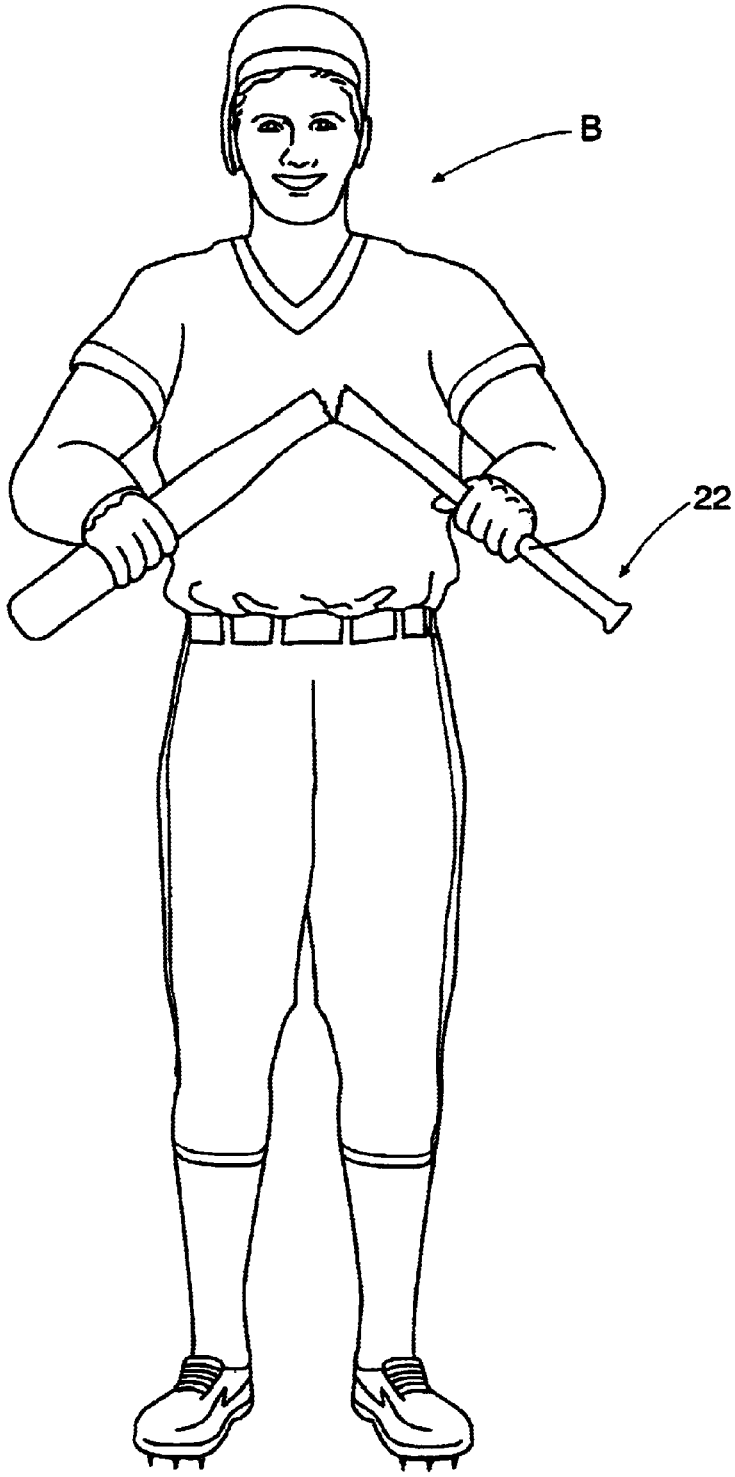
FIG. 4 is a representation of an alternative embodiment, showing a frustrated tennis player bending a novelty tennis racquet.

FIG. 4 depicts an alternative embodiment of the present invention, a novelty disposable baseball bat 22. A stressed-out ball player B reduces frustration by bending or breaking the bat 22.

Figure 5:
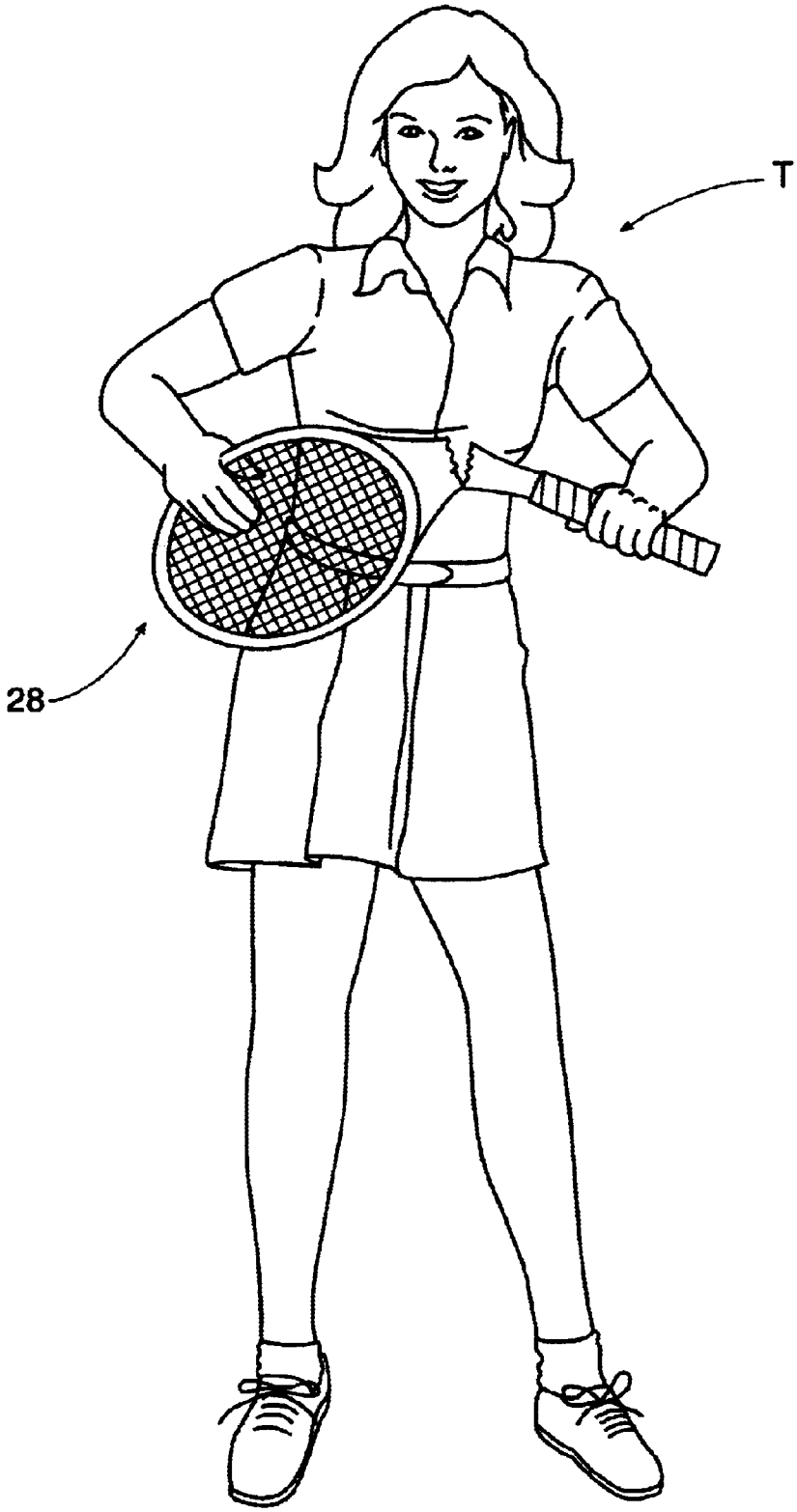
FIG. 5 is a representation of an alternative embodiment, showing a frustrated baseball player bending a novelty baseball bat.

FIG. 5 depicts yet another embodiment of the present invention, a novelty disposable racquet. The frustrated player T alleviates stress by dramatically bending or selectively breaking the racquet 28.

The above-described embodiments of this invention are merely descriptive of its principles and are not to be limited. The scope of this invention instead shall be determined from the scope of the following claims, including their equivalents.

What is claimed is:

1. A method of using a novelty sports apparatus in a dramatic and humorous way to relieve frustration and stress comprising:

obtaining a novelty sports apparatus having a shaft, the shaft comprising a resilient polymer material having an elastic memory to allow bending of the shaft from an original generally straightened condition in response to a bending force and the return of the shaft to the original generally straightened condition once the bending force is removed, and an annular score line about which the shaft resiliently bends until a maximum bend angle of at least 25 degrees is reached and along which the shaft breaks when the maximum bend angle is exceeded;

with the shaft in the original, generally straightened condition, grasping an end of a shaft with a hand on one side of the score line;

with the shaft in the original, generally straightened condition, holding a second end of the shaft with a second hand on an opposite side of the score line;

applying a bending force to bend the shaft from the original, generally straightened condition to a bend angle less than the maximum bend angle; and selecting between a bend option (1) and a bend option (2), the bend option (1) comprising releasing the bending force to allow the resilient return of the shaft to the original, generally straightened condition, and the bend option (2) comprising continuing to apply the bending force to bend the shaft beyond the maximum bend angle to break the shaft.

2. A method as in claim 1 wherein the maximum bend angle is about 45 degrees.

3. A method as in claim 1 wherein the shaft carries a golf club head.

4. A method as in claim 1 wherein the shaft comprises a baseball bat.

5. A method according to claim 1 wherein the shaft carries a racquet.

* * * * *